US010028634B1

(12) United States Patent
Calderon

(10) Patent No.: US 10,028,634 B1
(45) Date of Patent: Jul. 24, 2018

(54) CLEANING DEVICE, CLOTH AND HOLDER

(71) Applicant: Carl Freudenberg KG, Weinheim (DE)

(72) Inventor: Joaquim Barrera Calderon, Weinheim (DE)

(73) Assignee: Carl Freudenberg KG, Weinheim (DE)

( * ) Notice: Subject to any disclaimer, the term of this patent is extended or adjusted under 35 U.S.C. 154(b) by 257 days.

(21) Appl. No.: 14/907,293

(22) PCT Filed: Jul. 3, 2014

(86) PCT No.: PCT/EP2014/001833
§ 371 (c)(1),
(2) Date: Jan. 25, 2016

(87) PCT Pub. No.: WO2015/010769
PCT Pub. Date: Jan. 29, 2015

(30) Foreign Application Priority Data

Jul. 25, 2013 (DE) ..... 10 2013 012 373

(51) Int. Cl.
*A47L 13/20* (2006.01)
*A47L 13/253* (2006.01)
*A47L 13/258* (2006.01)

(52) U.S. Cl.
CPC ..... *A47L 13/253* (2013.01); *A47L 13/20* (2013.01); *A47L 13/258* (2013.01)

(58) Field of Classification Search
CPC ..... A47L 13/20; A47L 13/24; A47L 13/25; A47L 13/252; A47L 13/253; A47L 13/254; A47L 13/255; A47L 13/256; A47L 13/258
USPC ..... 15/147.1, 147.2, 228, 229.1–229.9
See application file for complete search history.

(56) References Cited

U.S. PATENT DOCUMENTS

| | | | |
|---|---|---|---|
| 4,914,778 | A | 4/1990 | Thompson |
| 5,613,263 | A | 3/1997 | Nolte |
| 2004/0034956 | A1 | 2/2004 | Tanaka et al. |

FOREIGN PATENT DOCUMENTS

| | | | |
|---|---|---|---|
| DE | 3246161 | A1 | 6/1984 |
| DE | 9016501 | U1 | 7/1991 |
| DE | 4316890 | A1 | 11/1994 |
| DE | 19508171 | A1 | 9/1995 |
| DE | 60126318 | T2 | 9/2007 |
| DE | 102006019903 | B3 | 10/2007 |
| DE | 102007005973 | A1 | 8/2008 |
| EP | 0858765 | B1 | 8/1998 |
| EP | 935945 | * | 8/1999 |
| EP | 1281344 | * | 2/2003 |

* cited by examiner

*Primary Examiner* — Mark Spisich
(74) *Attorney, Agent, or Firm* — Leydig, Voit & Mayer, Ltd.

(57) ABSTRACT

A cleaning device has a support body with two foldable frame elements and a cloth which has two pockets for receiving the frame elements. The two frame elements can be detachably arranged in the pockets. A holder may be arranged inside each packet, the holders and the corresponding frame elements may be interconnected in a nondestructive manner.

17 Claims, 7 Drawing Sheets

CLEANING DEVICE, CLOTH AND HOLDER

CROSS-REFERENCE TO RELATED APPLICATIONS

This application is a U.S. national stage application under 35 U.S.C. § 371 of International Application No. PCT/EP2014/001833, filed on Jul. 3, 2014, and claims benefit to German Patent Application No. DE 10 2013 012 373.9, filed on Jul. 25, 2013. The International Application was published in German on Jan. 29, 2015, as WO 2015/010769 A1 under PCT Article 21(2).

FIELD

The invention relates to a cleaning device, a cloth and a holder.

BACKGROUND

Such a cleaning device is known from EP 0 858 765 B1. The pockets are arranged on the top surface of the cloth, one of the two pockets interacting with an additional holder for attachment to a frame element. The additional holder is arranged on the top surface of the pocket and is formed by a pliable bracket into which the frame element is clippable.

The frame elements are folded for wringing out the cloth, one side of the cloth remaining connected to the corresponding frame element by means of the pliable bracket, whilst the other side of the cloth hangs down freely and is insertable into a wringer for wringing out.

SUMMARY

An aspect of the invention provides a cleaning device, comprising: a support body including a first foldable frame element and a second foldable frame element; and a cloth including a first pocket and a second pocket, each pocket being configured to receive one or more of the frame elements, wherein the frame elements are arranged so as to be detachable in the pockets, wherein a holder is arranged inside each pocket, and wherein the holders and corresponding frame elements are connected together so as to be non-destructively detachable.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
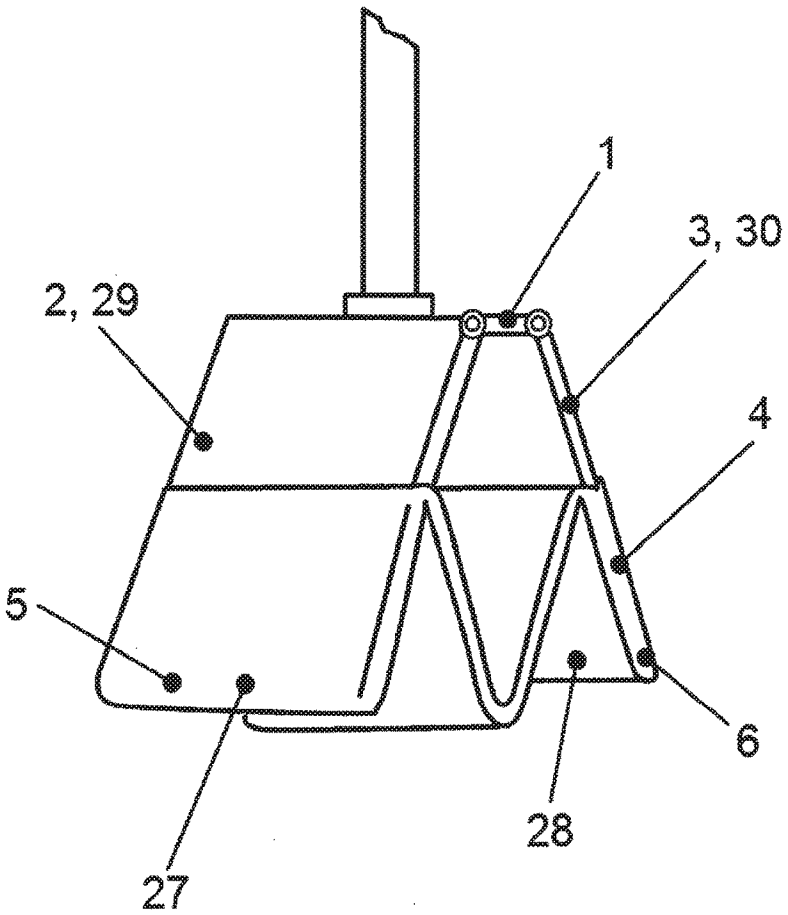
FIG. 1 shows an exemplary embodiment of the cleaning device according to the invention in the folded state.

An aspect of the invention provides a cleaning device, a cloth, and a holder, wherein the cleaning device includes a support body with two foldable frame elements and a cloth which comprises two pockets for receiving the frame elements, wherein the two frame elements are arranged so as to be detachable in the pockets.

An aspect of the invention is to develop a cleaning device and a cloth further in such a manner that the respective handling is simplified. In particular, the two frame elements should be connected to the cloth even when they are folded.

An aspect of the invention provides that in each case a holder is arranged inside each pocket and that the holders and the corresponding frame elements are connected together so as to be non-destructively detachable.

The frame elements are therefore not just inserted loosely into the pocket, as in the previously named prior art, such that at least one side of the cloth, once the frame elements have been folded together, automatically slips down from the corresponding frame element and said side is consequently no longer connected to the support body.

Instead of which, the support body and the cloth are always connected together whilst the cleaning device is being used as intended, that is to say even when the cloth is to be wrung out in a wringer. Both when the frame elements are not folded and when the frame elements are folded, they are always connected to the holders in the respective pocket of the cloth.

In addition, it is advantageous for the pocket of the cloth to comprise a level top surface. As a result, the pack size of the cloths is reduced to a minimum and the cloths can be kept stacked one on top of another without them slipping in an unwanted manner relative to one another. This is enormously advantageous in particular for professional applications.

The support body and cloth are therefore only detached and connected when a cloth is changed, but not in the intervening period. The frame elements remain held in the respective pockets by the holders even for wringing out the cloth.

It is preferred for the holders and the frame elements to be connected together in each case in a positive locking manner. As a result of the positive locking connection between the holders and the corresponding frame elements, the handling of the cleaning device is particularly simple. In order to connect the cloth to the support body, the cloth is placed, for example, flatly onto the surface to be cleaned and the folded frame elements are inserted into the pockets. As the frame elements move into the pockets, for example as a result of pressure onto the handle of the cleaning device, said frame elements are automatically connected to the corresponding holders which are arranged in the pockets such that manual connection of the covering to the support body is not required. This is advantageous from the point of view of hygiene.

It can be provided according to a first development that at least one of the holders is realized as a clip element. The clip element can be realized in a substantially C-shaped manner and comprises a lead-in chamfer for the corresponding frame element. As a result, it is particularly simple to pull the cloth onto the frame elements and the risk of errors during assembly is reduced to a minimum.

When the frame elements are inserted into the pockets, the frame elements initially abut against the lead-in chamfer of the clip element. The clip element is then briefly widened elastically until the clip element is connected in a positive locking manner to the corresponding frame element. The frame elements are therefore connected fixedly, but detachably to the cloth, inside both pockets.

According to another development, at least one of the holders can be realized as a barbed hook. The barbed hook can include several lamellae, between which the corresponding frame element is received. For a secure connection between the barbed hook and the corresponding frame element, it has proved advantageous when the lamellae comprise a height which is at least 1.1 times greater than the height of the frame element which is received between the lamellae.

In order to achieve the barbed hook effect, the lamellae are inclined in the direction of insertion of the frame elements, that is to say in the direction of the closed end-face boundary of the pockets. When the frame elements are folded together, the lamella, which is located in the direction of the opening of the pocket, is moved over the frame element and as a result holds the cloth and the frame element fixedly against one another.

It can be provided according to an advantageous development that structurally identical holders are used in both pockets of a cloth. In the previously described embodiments, in both pockets in each case there would be one clip element or in each case one barbed hook.

As a result of using holders which are realized as identical parts, the producibility of the cloth is simplified and cost-efficient.

The holders can consist of an elastically pliable, polymer material. In this connection, it is advantageous for such holders to weigh only a small amount and to be resistant to the majority of cleaning agents with which the cloth comes into contact.

The holders can comprise at least two receiving means for the respective frame elements, which receiving means are arranged located one behind another in the direction of insertion of the frame elements. In this connection, it is advantageous for different length frame elements to be able to be used when utilizing one and the same cloth, and/or for shrinkage of the cloth, which can occur, for example, after the cleaning thereof, is able to be compensated.

The holders are arranged in a preferred manner in each pocket at the back in the direction of insertion, in the region of the closed end-face boundary of the pockets. As a result, the pockets are guided by the tensioning frame brackets over their entire length and the cloth pulled onto the support body is also realized in an extensively even manner over its entire length as a result and can be easily handled in order to achieve a good cleaning result.

The holders can be sewn, bonded or welded into the pockets.

Holders that are sewn into the pockets are particularly durable. When the cloth is being produced, in the majority of cases the closed end-face boundary of the pockets is stitched down such that during said stitching the holder is able to be sewn-in in the same operating step.

Holders that are bonded-in or welded-in are also possible. Such a fastening of the holders in the pockets is mainly provided when the durability of sewn-in holders does not lead to the desired durability, for example as a result of the material used to make up the cloth.

The frame elements can be formed in each case by a metal wire bracket. In a further preferred manner, the metal wire bracket has a round cross section. The positive locking of such a wire bracket in the holders, in particular in the clip element, functions particularly well.

An angular cross section of the wire bracket could accordingly make the mounting of the cloth onto the frame element more difficult and/or damage the holders and/or the pockets when the cleaning device is used as intended.

As an alternative, the frame elements can be realized in a plate-shaped manner. As a result of developing the outside edges of the frame elements in a corresponding manner, a connection to the clip elements can also be produced.

When the frame elements are folded, the cloth comprises a substantially M-shaped form. As a result, the cloth pulled onto the frame elements can be inserted into a wringer in a simple manner. The shape of the cloth pulled onto the folded frame element is particularly compact and, as a result, can be inserted in a particularly simple manner into a wringer to be wrung out. Compared to a mop which droops in a U-shaped manner or even a mop which hangs down from the support body on only one side, the user does not have to lift the cleaning device as high into the wringer.

As a result of the low overall height of the substantially M-shaped form, the cleaning device is also suitable in a particularly good manner for wringing out in a manual or electric rotary wringer as the low overall height of the folded cleaning device enables a low center of gravity in the wringer and consequently improves the stability of the overall system.

In addition, the invention relates to a cloth with holders, as previously described.

One exemplary embodiment of a cleaning device according to the invention and two exemplary embodiments of cloths which can be used are described in more detail below by way of the figures.

Figure 7:
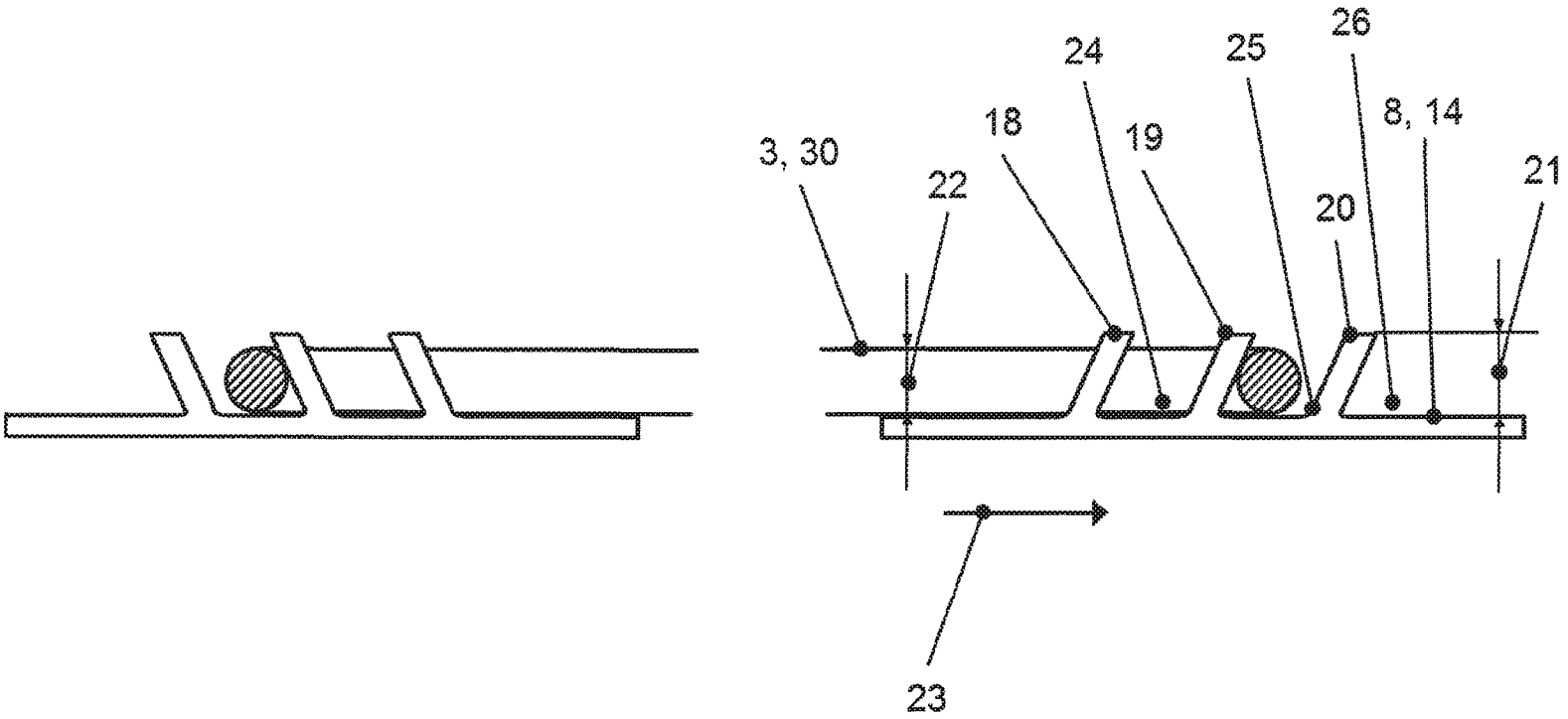

FIG. 1 shows an exemplary embodiment of the cleaning device according to the invention in the folded state. The support body 1 includes the two frame elements 2, 3 which are formed in each case by a metal wire bracket 29, 30. The wire brackets 29, 30 have in each case a circular cross section, as shown in FIG. 7.

The cloth 4 has on its top surface two pockets 5, 6 in which the corresponding frame elements 2, 3 are arranged. The fact that in each case one holder 7, 8, which encompasses the corresponding frame elements 2, 3 in a non-destructively detachable and positive locking manner, is arranged in each pocket 5, 6 is not visible in said representation.

In the non-folded state of the cleaning device, the cloth 4 is tensioned evenly by the two non-folded frame elements 2, 3, for cleaning even surfaces, for example for cleaning floors.

In the folded state, the cloth 4 has a substantially M-shaped form. The folded support body 1 and the cloth, which is connected to the frame elements 2, 3 on its two longitudinal sides even in said folded state by means of the frame elements 2, 3, comprise, as a result, a compact form and can be wrung out in an ergonomically favorable manner in a wringer.

In contrast to cloths that droop in U-shaped manner, the height of the folded cleaning device is substantially lower such that the lifting movement for inserting the cleaning device into a wringer can be comparatively smaller.

Figure 2:
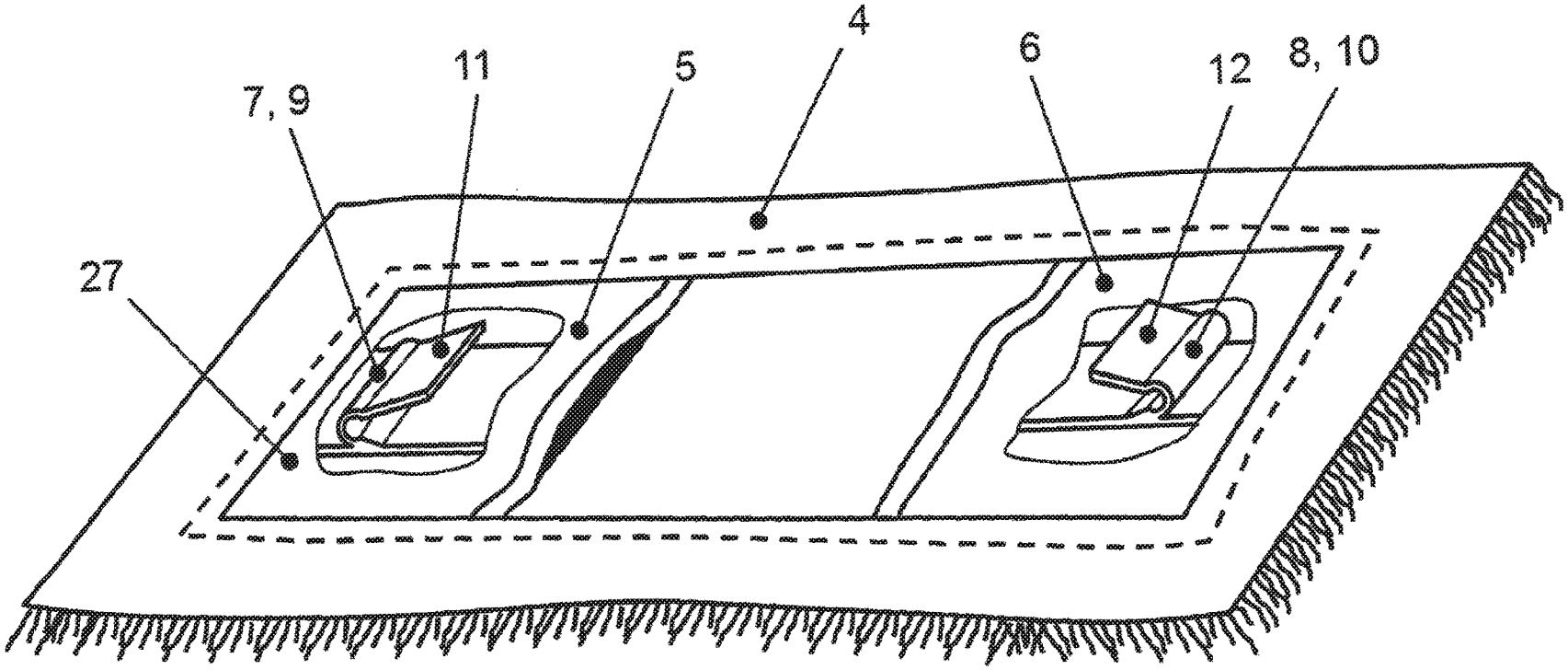
FIG. 2 shows the pocket of a cloth which has been unstitched for illustrative purposes and in which a holder is arranged.

FIG. 2 also shows the cloth 4 from FIG. 1 as an individual part.

To explain the invention better, the pocket 5 is shown cut open in this case in order to be able to see better the holder 7 which is arranged in the pocket 5.

The holders 7, 8 are realized as clip elements 9, 10, are developed in a substantially C-shaped manner and have in each case a lead-in chamfer 11, 12 for the corresponding frame element 2, 3.

The pockets 5, 6 of the cloth 4 are realized in a manner that corresponds to one another, the holders 7, 8 being realized as identical parts. The holders 7, 8 are sewn into the pockets 5, 6 in each case.

Figure 3:
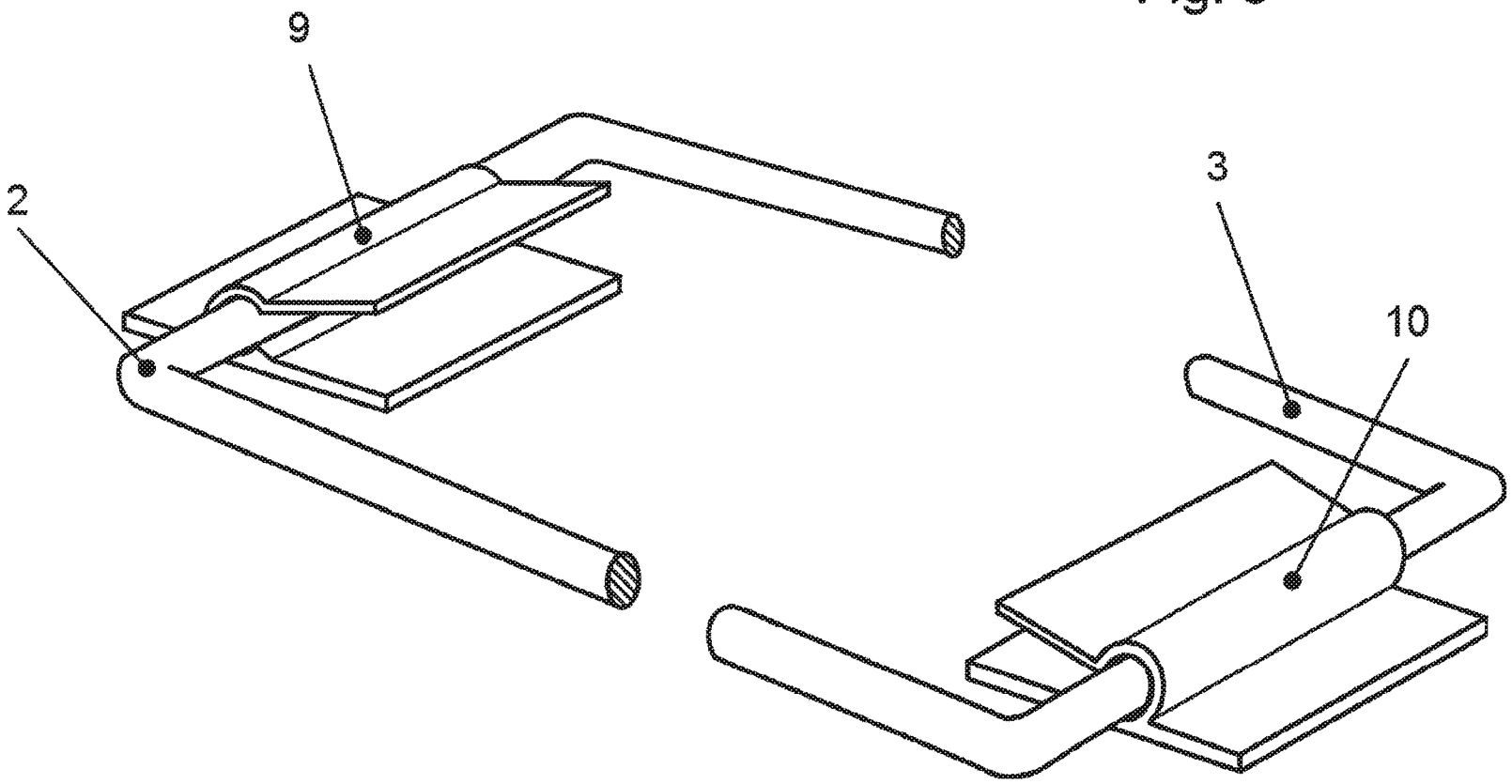
FIG. 3 shows the holder from FIG. 2, the corresponding frame element being inserted into the holder in a positive locking manner.

FIG. 3 shows the clip elements 9, 10 which surround the corresponding frame elements 2, 3 in a positive locking manner. Normally, when the pockets 5, 6 are not cut open only for demonstration purposes, the holders 7, 8 are arranged fully in the pockets 5, 6 and are not visible from the outside.

Figure 4:
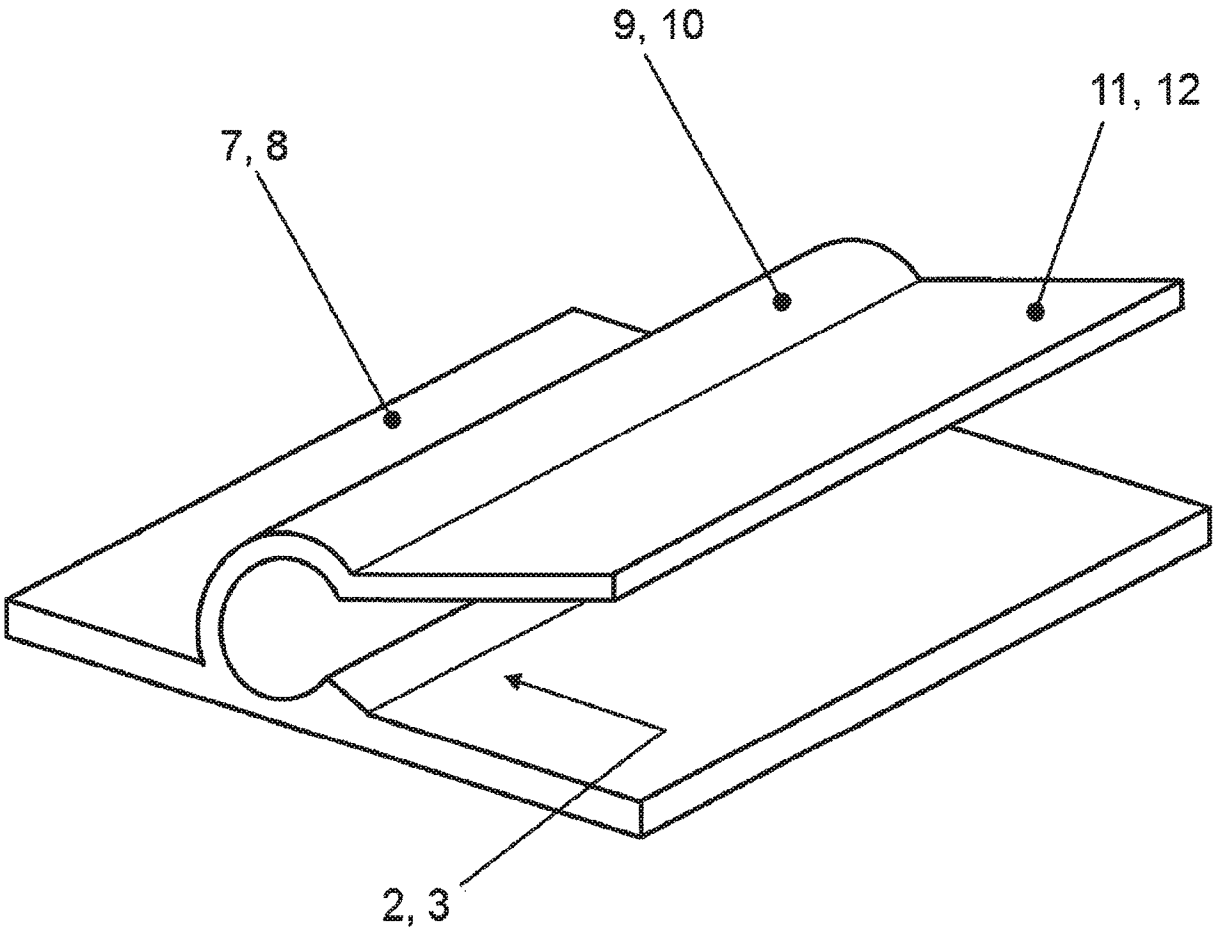
FIG. 4 shows the holder from FIGS. 2 and 3 as an individual part, the holder being realized as a clip element.

FIG. 4 shows the holders 7 and 8, which are formed by the clip elements 9, 10 as an individual part. If the corresponding frame elements 2, 3 are inserted into the clip elements 9, 10 by means of the lead-in chamfers 11, 12, the clip elements 9, 10 widen briefly elastically until the frame elements 2, 3 snap into the clip elements 9, 10. A non-destructively detachable and positive-locking connection is produced as a result.

Figure 5:
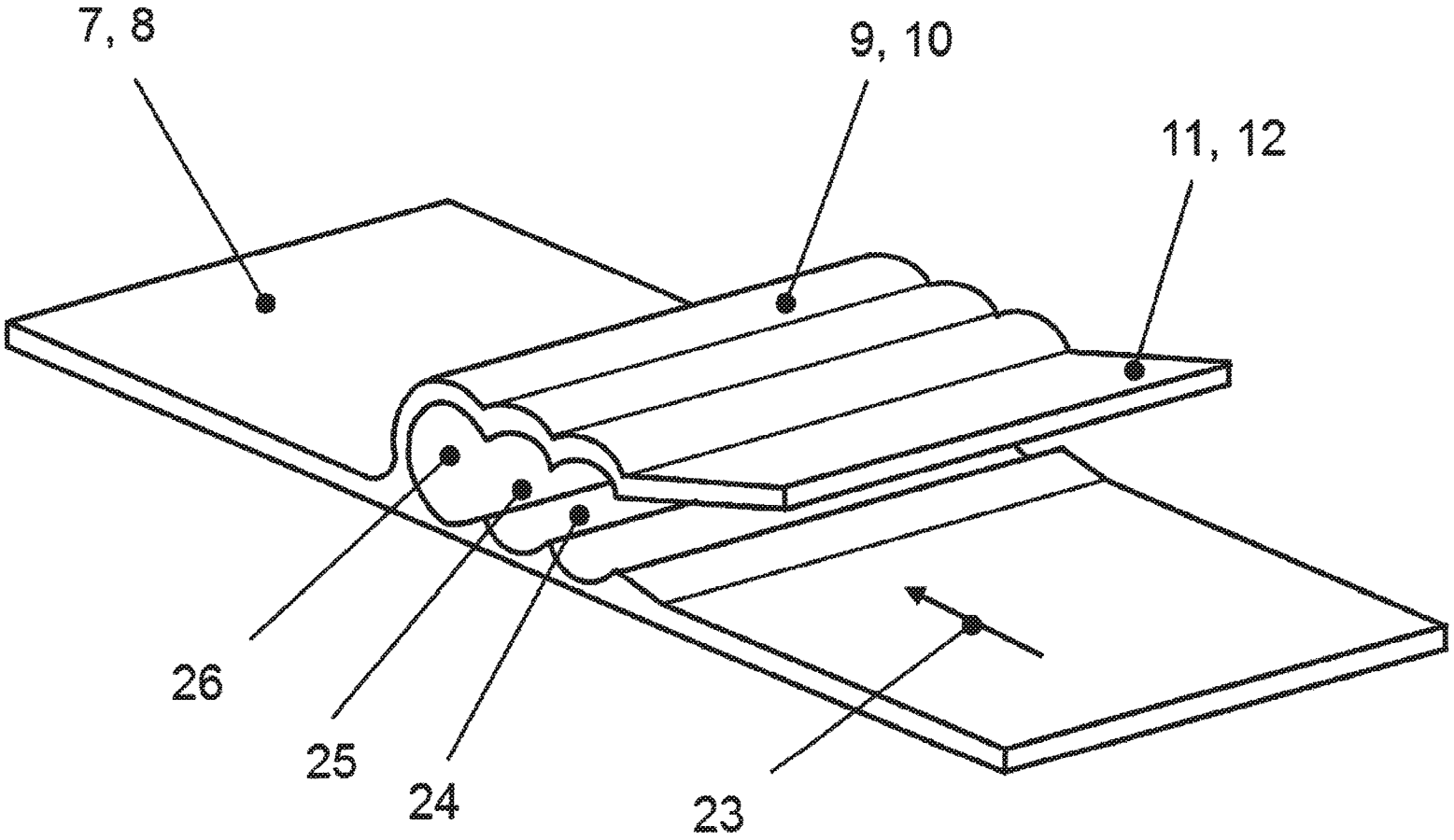
FIG. 5 shows a development which is alternative to the holder from FIG. 4.

FIG. 5 shows an alternative embodiment to the clip elements 9, 10 from FIG. 4. The clip elements 9, 10 from FIG. 4 have only one latching position, whereas the clip elements 9, 10 from FIG. 5 comprise three receiving means 24, 25, 26 for the respective frame elements 2, 3, which receiving means are arranged one behind the another in the direction of insertion 23 of the frame elements 2, 3.

Different length tensioning frames 2, 3 and/or possible shrinkage of the cloth 4 can be compensated for as a result of said development.

Figure 6:
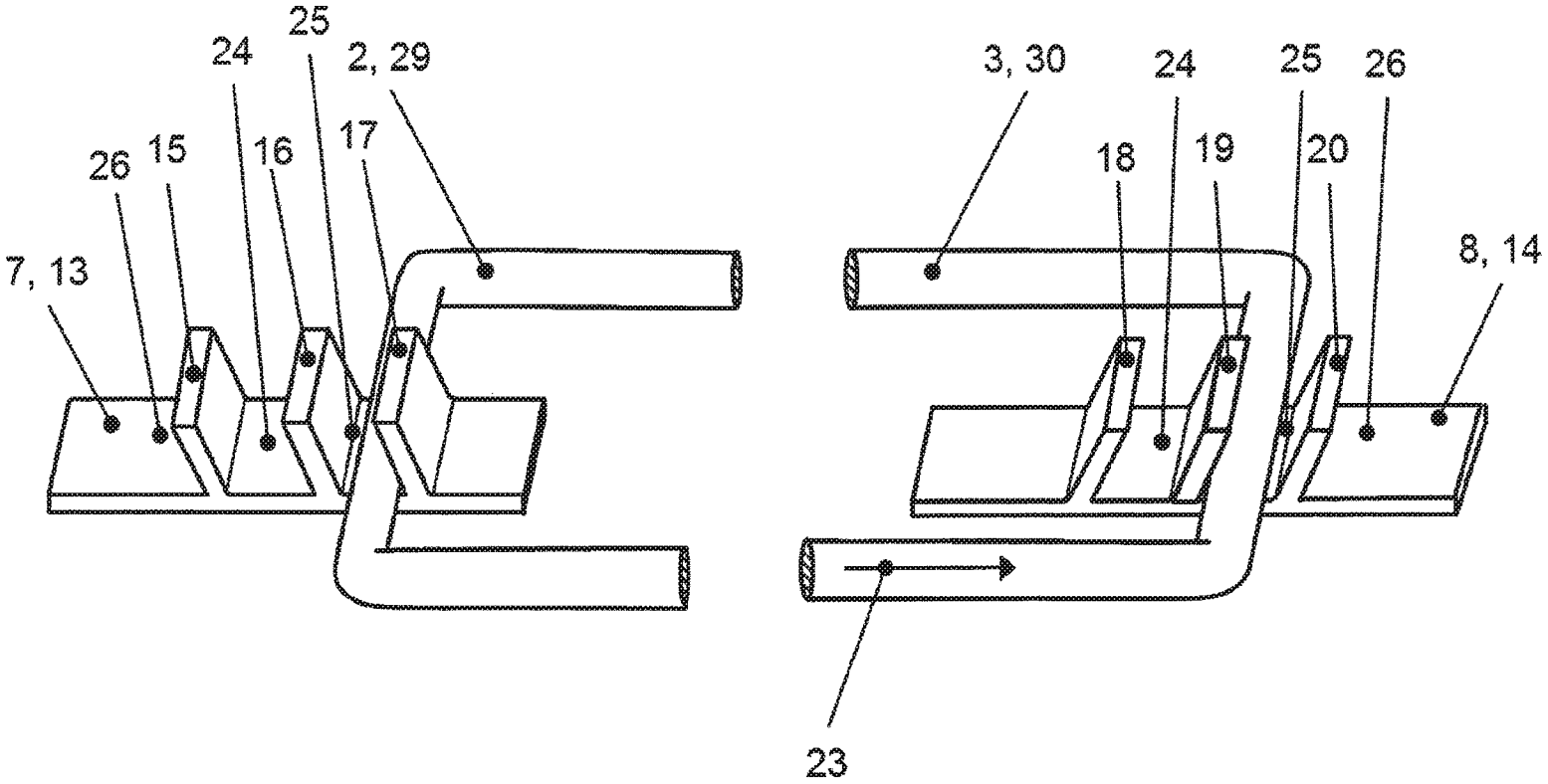
FIG. 6 shows a perspective view of a holder which is realized as a barbed hook and FIG. 7 shows a longitudinally sectioned representation of the holder from FIG. 6.

FIGS. 6 and 7 shows an alternatively formed holder 7, 8. Just like the clip elements 9, 10 from FIGS. 2 to 5, the holders 7, 8 which are realized as barbed hooks 13, 14, are produced from an elastically pliable, polymer material.

In principle, similarly as to the clip elements 9, 10 from FIG. 5, the barbed hooks 13, 14 are provided with three receiving means 24, 25, 26 for receiving the corresponding frame elements 2, 3. This is made possible by the lamellae 15, 16, 17, 18, 19, 20 of the barbed hooks 13, 14, the frame elements 2, 3 being received between the lamellae 15, 16, 17, 18, 19, 20 when the cleaning device is being used as intended.

FIG. 7 shows a longitudinally sectioned representation of the lamellae 15, 16, 17, 18, 19, 20 from FIG. 6, mounted with the frame elements 2, 3. The lamellae 15, 16, 17, 18, 19, 20 comprise a height 21 which, in the case shown here, is 1.2 times greater than the height 22 of the frame elements 2, 3 which are received between the lamellae 15, 16, 17, 18, 19, 20.

The holders 7, 8 shown in FIGS. 2 to 7 are arranged in each pocket 5, 6 at the back in the direction of insertion 23, in the region of the closed end-face boundaries 27, 28 of the pockets 5, 6.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A cleaning device, comprising:

a support body including a first foldable frame element and a second foldable frame element; and a cloth including a first pocket and a second pocket, each pocket being configured to receive a selected one of the frame elements, wherein the frame elements are arranged so as to be detachable in the pockets, wherein a holder is arranged inside each pocket, and wherein the holders and corresponding frame elements are automatically, without manual connection, connected together in a non-destructively detachable manner during movement of the frame elements into the pockets.

2. The device of claim 1, wherein the holders and the frame elements are connected together in each case in a positive locking manner.

3. The device of claim 1, wherein at least one of the holders is a clip element.

4. The device of claim 3, wherein the clip element is substantially C-shaped, and wherein the clip element includes a lead-in chamfer configured for a corresponding frame element.

5. The device of claim 3, wherein at least one of the holders is a barbed hook.

6. The device of claim 1, wherein at least one of the holders is a barbed hook.

7. The device of claim 6, wherein the barbed hook includes lamellae.

8. The device of claim 7, wherein the lamellae have a height which is at least 1.1 times greater than a frame element height, which is received between the lamellae.

9. The device of claim 1, wherein the holders include an elastically pliable, polymer material.

10. The device of claim 1, wherein the holders comprise at least two receiving means for the respective frame elements, which receiving means are arranged located one behind another in the direction of insertion of the frame elements.

11. The device of claim 1, wherein the holders are arranged at the back in the direction of insertion in each pocket, in the region of the closed end-face boundary of the pockets.

12. The device of claim 1, wherein the holders are sewn, bonded or welded into the pockets.

13. The device of claim 1, wherein the frame elements are formed in each case by a metal wire bracket.

14. The device of claim 1, wherein, when the frame elements are folded, the cloth has is substantially M-shaped.

15. The device of claim 1, wherein the frame elements are clamping frame brackets.

16. The device of claim 1, comprising no further frame elements.

17. The device of claim 1, wherein the holders consist of an elastically pliable, polymer material.

* * * * *